US011151947B2

(12) United States Patent
In et al.

(10) Patent No.: US 11,151,947 B2
(45) **Date of Patent: *Oct. 19, 2021**

(54) ORGANIC LIGHT EMITTING DISPLAY DEVICE UTILIZING COMPENSATOR TO IMPROVE DISPLAY QUALITY

(71) Applicant: Samsung Display Co., Ltd., Yongin-si (KR)

(72) Inventors: Hai Jung In, Yongin-si (KR); Dong Gyu Kim, Yongin-si (KR); Bo Yong Chung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/882,384

(22) Filed: May 22, 2020

(65) Prior Publication Data

US 2020/0286434 A1 Sep. 10, 2020

Related U.S. Application Data

(63) Continuation of application No. 16/557,465, filed on Aug. 30, 2019, now Pat. No. 10,665,173, which is a (Continued)

(30) Foreign Application Priority Data

Aug. 27, 2015 (KR) ..... 10-2015-0120984

(51) Int. Cl.
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2300/0814* (2013.01); (Continued)

(58) Field of Classification Search
CPC ..... G09G 3/3233; G09G 3/3275; G09G 2320/0233; G09G 2320/043; (Continued)

(56) References Cited

U.S. PATENT DOCUMENTS 8,519,917 B2 8/2013 Ryu et al.
8,599,114 B2 12/2013 Kim et al.
(Continued)

FOREIGN PATENT DOCUMENTS

KR 10-2010-0110060 A 10/2010
KR 10-2011-0039773 A 4/2011
(Continued)

*Primary Examiner* — Kwang-Su Yang
(74) *Attorney, Agent, or Firm* — Lewis Roca Rothgerber Christie LLP

(57) ABSTRACT

An organic light emitting display device includes pixels, a sensor configured to extract at least one of deviation information of first transistors of the pixels and deterioration information of OLEDs of the pixels in a sensing period, and a converter configured to change a bit of first data input from the outside by using at least one of the deviation information and the deterioration information, and to generate second data, wherein a pixel at an ith horizontal line includes an OLED, a first transistor configured to control an amount of a current that flows from a first power source via the OLED in response to a voltage of a first node, second and third transistors configured to turn on when a scan signal is supplied to an ith scan line, and a fourth transistor configured to turn on when a control signal is supplied to an ith control line.

18 Claims, 9 Drawing Sheets

Related U.S. Application Data continuation of application No. 15/236,178, filed on Aug. 12, 2016, now Pat. No. 10,403,211.

(52) U.S. Cl.
CPC . *G09G 2300/0842* (2013.01); *G09G 2310/08* (2013.01); *G09G 2320/0233* (2013.01); *G09G 2320/0295* (2013.01); *G09G 2320/043* (2013.01); *G09G 2320/045* (2013.01); *G09G 2320/0626* (2013.01)

(58) Field of Classification Search
CPC ... G09G 2300/0842; G09G 2300/0814; G09G 2310/08; G09G 2320/0626
See application file for complete search history.

(56) References Cited

U.S. PATENT DOCUMENTS

| | | | | |
|---|---|---|---|---|
| 8,952,951 | B2 | 2/2015 | Yoo et al. | |
| 9,041,633 | B2 | 5/2015 | Park et al. | |
| 10,403,211 | B2 | 9/2019 | Hai et al. | |
| 2009/0027377 | A1 | 1/2009 | Kwon | |
| 2010/0253608 | A1 | 10/2010 | Kim et al. | |
| 2011/0018858 | A1 | 1/2011 | Ryu et al. | |
| 2011/0084955 | A1 | 4/2011 | Kim | |
| 2011/0115772 | A1* | 5/2011 | Chung | G09G 3/3233 345/211 |
| 2011/0216056 | A1 | 9/2011 | Yoo et al. | |
| 2011/0298836 | A1* | 12/2011 | Komiya | G09G 3/3233 345/690 |
| 2011/0316892 | A1 | 12/2011 | Sung et al. | |
| 2015/0187273 | A1 | 7/2015 | Chang et al. | |
| 2016/0171930 | A1 | 6/2016 | Song et al. | |
| 2016/0190166 | A1 | 6/2016 | Kim et al. | |

FOREIGN PATENT DOCUMENTS

| | | | |
|---|---|---|---|
| KR | 10-1056258 | B1 | 8/2011 |
| KR | 10-2011-0099581 | A | 9/2011 |
| KR | 10-2011-0104705 | A | 9/2011 |
| KR | 10-2012-0000887 | A | 1/2012 |

* cited by examiner

ORGANIC LIGHT EMITTING DISPLAY DEVICE UTILIZING COMPENSATOR TO IMPROVE DISPLAY QUALITY

CROSS-REFERENCE TO RELATED APPLICATIONS

This application is a continuation of U.S. patent application Ser. No. 16/557,465, filed Aug. 30, 2019, which is a continuation of U.S. patent application Ser. No. 15/236,178, filed Aug. 12, 2016, now U.S. Pat. No. 10,403,211, which claims priority to, and the benefit of, Korean Patent Application No. 10-2015-0120984, filed on Aug. 27, 2015, in the Korean Intellectual Property Office, the entire content of all of which is incorporated herein by reference.

BACKGROUND

1. Field

An embodiment of the present invention relates to an organic light emitting display device, and more particularly, to an organic light emitting display device capable of improving display quality.

2. Description of the Related Art

With the development of information technology, importance of display apparatuses as connection mediums between users and information is becoming ever more apparent. In line with this, uses of display apparatuses (such as liquid crystal display devices and/or organic light emitting display devices) are increasing.

Among the display apparatuses, an organic light emitting display device displays an image by using organic light emitting diodes (OLED) that generate light components (colors) by re-combination of electrons and holes. The organic light emitting display device has a high response speed and is driven with low power consumption.

The organic light emitting display device includes a plurality of pixels arranged at crossings (e.g., intersections) of a plurality of data lines and scan lines in a matrix. Each of the pixels is commonly formed of an OLED, two or more transistors including a driving transistor, and one or more capacitors.

The organic light emitting display device uses a small amount of power. However, due to deviation among threshold voltages of driving transistors included in the pixels, amounts of currents that flow to the OLEDs change so that non-uniformity in display is caused.

In addition, brightness of an OLED changes due to a change in efficiency in accordance with deterioration of the OLED. With the lapse of time, the OLED deteriorates so that light with lower brightness is generated in response to the same data signal.

SUMMARY

Aspects of embodiments of the present invention are directed to an organic light emitting display device capable of improving display quality.

According to some embodiments of the present invention, there is a provided an organic light emitting display device including: pixels at crossing regions of scan lines, control lines, and data lines; a sensor configured to extract at least one of deviation information of first transistors included in the pixels and deterioration information of organic light emitting diodes (OLEDs) included in the pixels in a sensing period; and a converter configured to change a bit of first data input from the outside by using at least one of the deviation information and the deterioration information, and further configured to generate second data, wherein a pixel at an ith (i is a natural number) horizontal line includes: an organic light emitting diode; a first transistor of the first transistors configured to control an amount of a current that flows from a first power source to a second power source via the organic light emitting diode in response to a voltage of a first node; a second transistor connected between a data line and the first node and configured to turn on when a scan signal is supplied to an ith scan line; a third transistor connected between an anode electrode of the organic light emitting diode and a third power source and configured to turn on when the scan signal is supplied to the ith scan line; a fourth transistor connected between the data line and the anode electrode of the organic light emitting diode and configured to turn on when a control signal is supplied to an ith control line; and a storage capacitor connected between the first node and the anode electrode of the organic light emitting diode.

In an embodiment, each of the first transistor to the fourth transistor includes n-channel metal-oxide-semiconductor field-effect transistors (NMOSs).

In an embodiment, the third power source is configured to supply a voltage at which the organic light emitting diode is turned off.

In an embodiment, the third power source is a same as the second power source.

In an embodiment, the converter is configured to generate the second data to compensate for at least one of deviation among the first transistor and deterioration of the organic light emitting diodes.

In an embodiment, the sensor includes: an analog-to-digital converter (ADC) configured to change at least one of the deviation information and the deterioration information into a digital value; and a memory configured to store the digital value.

In an embodiment, the organic light emitting display device further includes: a scan driver configured to supply scan signals to the scan lines; a control line driver configured to supply control signals to the control lines; a data driver configured to generate data signals by using the second data and to supply the data signals to the data lines; and a switch network configured to connect the data lines to at least one of the sensor and the data driver.

In an embodiment, the switch network includes: a first switch connected between the data lines and the data driver; and a second switch connected between the data lines and the sensor.

In an embodiment, in a sensing period in which the deviation information of the pixel in the ith horizontal line is extracted, the switch network is configured to connect the data lines to the data driver in a first period of the sensing period and to connect the data lines to the sensor in a second period of the sensing period, the scan driver is configured to supply a scan signal to the ith scan line in the first period, and the control line driver is configured to supply a control signal to the ith control line in the second period.

In an embodiment, the data driver is further configured to supply a reference data signal to turn on the first transistor in the first period.

In an embodiment, the deviation information includes a current supplied from the first transistor to the data line in the second period.

In an embodiment, in an initializing period between the first period and the second period, the switch network is configured to connect the data lines to the data driver, the control line driver is configured to supply the control signal to the ith control line, and the data driver is configured to supply an initializing voltage to the data lines.

In an embodiment, the initializing voltage is a voltage at which the organic light emitting diode is turned off.

In an embodiment, in a sensing period in which the deterioration information of the pixel in the ith horizontal line is extracted, the switch network is configured to connect the data lines to the data driver in a first period of the sensing period and to connect the data lines to the sensor in a second period of the sensing period, the scan driver is configured to supply the scan signal to the ith scan line in the first period, and the control line driver is configured to supply the control signal to the ith control line in the second period.

In an embodiment, the data driver is further configured to supply sensing data signals corresponding to black grayscale values to the data lines in the first period.

In an embodiment, the sensor is configured to supply a reference current or a reference voltage to the data lines in the second period.

In an embodiment, the deterioration information includes a voltage applied to the organic light emitting diode in response to the reference current or a current that flows from the organic light emitting diode in response to the reference voltage.

In an embodiment, in an initializing period between the first period and the second period, the switch network is configured to connect the data lines to the data driver, the control line driver is configured to supply the control signal to the ith control line, and the data driver is configured to supply an initializing voltage to the data lines.

In an embodiment, the initializing voltage is a voltage at which the organic light emitting diode is turned off.

In an embodiment, in a driving period in which the pixels implement grayscale values, the switch network is configured to connect the data lines to the data driver.

In the organic light emitting display device according to embodiments of the present invention, deterioration of the organic light emitting diodes and/or deviation among driving transistors are compensated for outside of the pixels so that display quality may be improved (e.g., increased). In addition, in the pixels according to the present invention, regardless of (and in spite of) voltage drop of the first power source ELVDD, the currents that flow through the driving transistors are uniformly maintained so that the display quality may be improved.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawings, dimensions may be exaggerated for clarity of illustration.

Like reference numerals refer to like elements throughout.

FIG. 1 is a view illustrating an organic light emitting display device according to an embodiment of the present invention;

FIG. 2 is a view illustrating a switching unit and a sensing unit according to an embodiment of the present invention;

FIG. 3A is a view illustrating the sensing circuit of FIG. 2 according to an embodiment of the present invention;

FIG. 3B is a view illustrating the sensing circuit of FIG. 2 according to another embodiment of the present invention;

FIG. 4 is a view illustrating a pixel according to an embodiment of the present invention;

FIG. 5A is a view illustrating waveforms from which deviation information of driving transistors is extracted in a sensing period, according to an embodiment of the present invention;

FIG. 5B is a view illustrating waveforms from which deviation information of driving transistors is extracted in a sensing period, according to another embodiment of the present invention;

FIG. 6A is a view illustrating waveforms from which deterioration information of an organic light emitting diode (OLED) is extracted in a sensing period, according to an embodiment of the present invention;

FIG. 6B is a view illustrating another embodiment of waveforms from which deterioration information of an OLED is extracted in a sensing period according to another embodiment of the present invention; and FIG. 7 is a view illustrating waveforms supplied to a pixel in a driving period according to an embodiment of the present invention.

DETAILED DESCRIPTION

Figure 1:
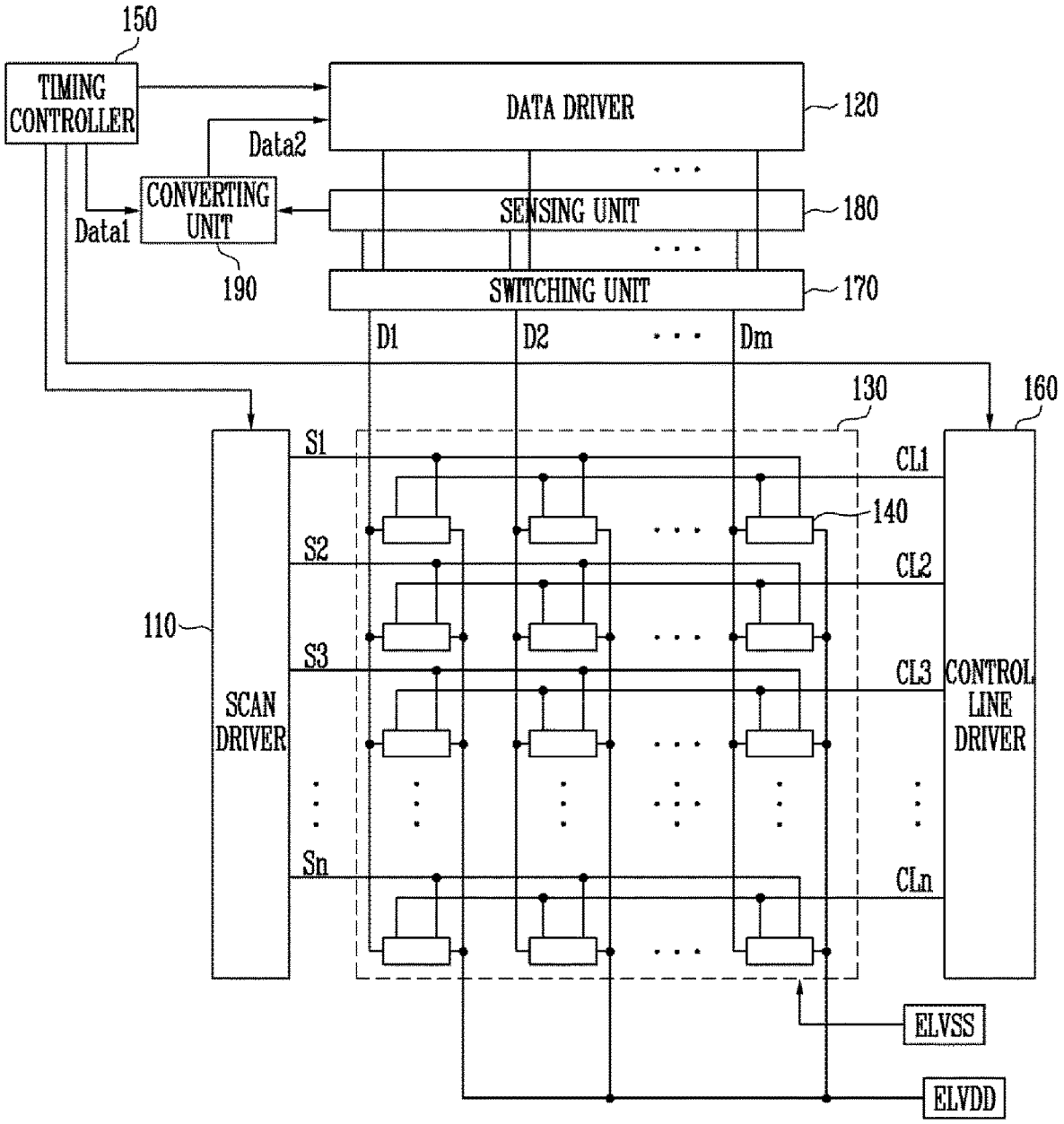

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will full convey the scope of the example embodiments to those skilled in the art.

In the drawings, dimensions may be exaggerated for clarity of illustration. Like reference numerals refer to like elements throughout.

FIG. 1 is a view illustrating an organic light emitting display device according to an embodiment of the present invention.

Referring to FIG. 1, the organic light emitting display device according to the embodiment of the present invention includes pixels 140 positioned in regions defined by (e.g., divided by) scan lines S1 to Sn, control lines CL1 to CLn, and data lines D1 to Dm; a scan driver 110 for driving the scan lines S1 to Sn; a control line driver 160 for driving the control lines CL1 to CLn; a data driver 120 for driving the data lines D1 to Dm; and a timing controller 150 for controlling the scan driver 110, the data driver 120, and the control line driver 160.

In addition, the organic light emitting display device according to the embodiment of the present invention includes a sensing unit (e.g., a sensor) 180 for extracting deterioration information of organic light emitting diodes (OLED) included in the pixels 140 and/or deviation information of driving transistors included in the pixels 140, a switching unit (e.g., a switch or switch network) 170 for connecting the data lines D1 to Dm to the sensing unit 180 and/or the data driver 120, and a converting unit (e.g., a converter) 190 for changing a bit of first data Data1 by using the deterioration information and/or the deviation information and generating second data Data2.

The organic light emitting display device according to the embodiment of the present invention is driven in a sensing period and a driving period. In the sensing period, the deterioration information of the OLEDs included in the pixels 140 and/or the deviation information of the driving transistors included in the pixels 140 are extracted. In the driving period, an image (e.g., a preset or predetermined image) is displayed.

The scan driver 110 supplies scan signals to the scan lines S1 to Sn in the sensing period and the driving period in response to control of the timing controller 150. For example, the scan driver 110 may sequentially supply the scan signals to the scan lines S1 to Sn. When the scan signals are sequentially supplied to the scan lines S1 to Sn, the pixels 140 are selected in units of horizontal lines (i.e., pixels 140 that are electrically connected to a same scan line are selected). Here, the scan signals are set to have gate on voltages that turns on the transistors included in the pixels 140.

The control line driver 160 supplies control signals to the control lines CL1 to CLn in the sensing period in response to the control of the timing controller 150. For example, the control line driver 160 may sequentially supply the control signals to the control lines CL1 to CLn. Here, the control signals are set to have gate on voltages that turn on the transistors included in the pixels 140.

The data driver 120 supplies a reference data signal to the data lines D1 to Dm in the sensing period in which the deviation information of the driving transistors is extracted. The reference data signal is set to have a voltage at which a current may flow through the driving transistors and may be set as one of data signals that may be supplied by the data driver 120.

The data driver 120 supplies sensing data signals to the data lines D1 to Dm in the sensing period in which the deterioration information of the organic light emitting diodes is extracted. The sensing data signals may be set as data signals corresponding to black grayscale values so that the driving transistors may be turned off.

The data driver 120 receives the second data Data2 in the driving period and generates the data signals by using the received second data Data2. The data signals generated by the data driver 120 are supplied to the data lines D1 to Dm. The data signals supplied to the data lines D1 to Dm are supplied to the pixels 140 that are selected by the scan signals, and the pixels 140 generate light components (colors) with preset or predetermined brightness components (colors) in response to the data signals.

The pixel unit (pixel array) 130 refers to a valid display region in which an image is displayed. The pixel unit 130 includes the pixels 140 positioned in the regions defined by (e.g., divided by) the scan lines S1 to Sn, the data lines D1 to Dm, and the control lines CL1 to CLn.

The pixels 140 receive a first power source ELVDD and a second power source ELVSS from the outside. When the scan signals are supplied, the corresponding pixels 140 are selected and store voltages corresponding to the data signals. The pixels 140 control amounts of currents supplied from the first power source ELVDD to the second power source ELVSS via the organic light emitting diodes in response to the data signals. Here, the pixels 140 control the amounts of the currents that flow to the organic light emitting diodes regardless of voltage drop of the first power source ELVDD.

The switching unit 170 connects the data lines D1 to Dm to the data driver 120 in the driving period. Then, in the driving period, the data signals are supplied from the data driver 120 to the data lines D1 to Dm. In addition, the switching unit 170 connects the data lines D1 to Dm to the data driver 120 or the sensing unit 180 in the sensing period.

The sensing unit 180 extracts the deterioration information of the organic light emitting diodes included in the pixels 140 and/or the deviation information of the driving transistors included in the pixels 140 in the sensing period, converts the extracted information into a digital value (or digital values), and stores the digital value(s) in a memory. The deviation information of the driving transistors refers to information including threshold voltages and mobility of the driving transistors.

The converting unit 190 changes the bit of the first data Data1 input from the timing controller 150 in response to the deterioration information and/or the deviation information from the sensing unit 180 (i.e., in response to the digital value(s)) and generates the second data Data2. Here, the second data Data2 is set so that the deterioration of the organic light emitting diodes and/or the deviation of the driving transistors are compensated for. The second data Data2 generated by the converting unit 190 is supplied to the data driver 120.

The timing controller 150 controls the scan driver 110, the data driver 120, and the control line driver 160. Then, the timing controller 150 realigns the first data Data1 supplied from the outside and supplies the realigned first data Data1 to the converting unit 190.

In FIG. 1, it is illustrated that the sensing unit 180 and the converting unit 190 are positioned outside the timing controller 150. However, the present invention is not limited thereto. For example, the sensing unit 180 and the converting unit 190 may be positioned in the timing controller 150.

Figure 2:
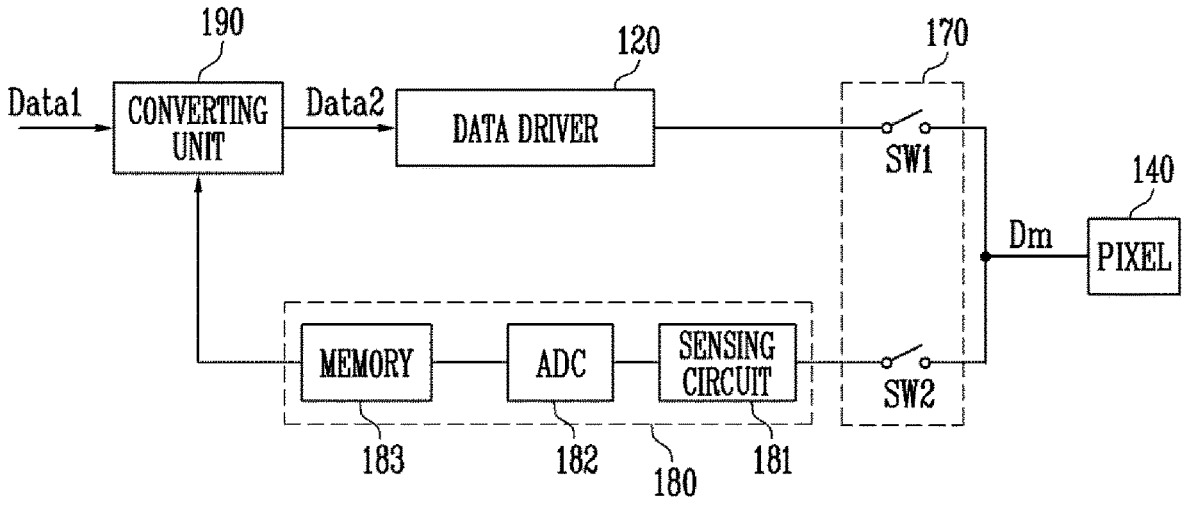

FIG. 2 is a view illustrating a switching unit 170 and a sensing unit 180 according to an embodiment of the present invention. In FIG. 2, for ease of illustration, a configuration connected to the mth data line Dm is illustrated.

Referring to FIG. 2, the switching unit 170 includes first and second switches SW1 and SW2 positioned in each channel. That is, the first and second switches SW1 and SW2 are connected to each of the data lines D1 to Dm.

The first switch SW1 is positioned between the data driver 120 and the data line Dm. The first switch SW1 maintains an on state in the driving period. Then, the first switch SW1 and the second switch SW2 are alternately turned on and off in the sensing period.

The second switch SW2 is positioned between the sensing unit 180 and the data line Dm. The second switch SW2 maintains an off state in the driving period. Then, the second switch SW2 and the first switch SW1 are alternately turned on and off in the sensing period. In addition, the first switch SW1 and the second switch SW2 may be turned on and off in response to the control of the timing controller 150.

The sensing unit 180 includes a sensing circuit 181, an analog-to-digital converter (hereinafter, referred to as ADC) 182, and a memory 183.

The sensing circuit 181 supplies the deterioration information and/or the deviation information from the pixel 140 to the ADC 182. Here, the sensing circuit 181 changes the deterioration information and/or the deviation information supplied as a current into a voltage and may supply the voltage to the ADC 182. In addition, the sensing circuit 181 may supply a reference voltage or a reference current to the data line Dm so that the deterioration information may be extracted from the pixel 140. A separate sensing circuit 181 may be utilized in each channel, or a same sensing circuit 181 may be shared by a plurality of channels.

The ADC 182 changes the deterioration information and/or the deviation information supplied from the sensing circuit 181 into the digital value(s) and supplies the digital value(s) to the memory 183. A separate ADC 182 may be utilized in each channel, or an ADC 182 may be shared by a plurality of channels.

The memory 183 stores the digital value(s) supplied from the ADC 182. For example, the deterioration information and the deviation information of the pixels 140 may be stored in the memory 183 as the digital value(s).

The converting unit 190 changes the bit of the first data Data1 by using the digital value(s) stored in the memory 183 so that the deterioration of the organic light emitting diodes and/or the deviation of the driving transistors may be compensated for, and the converting unit 190 generates the second data Data2.

Figure 3A:
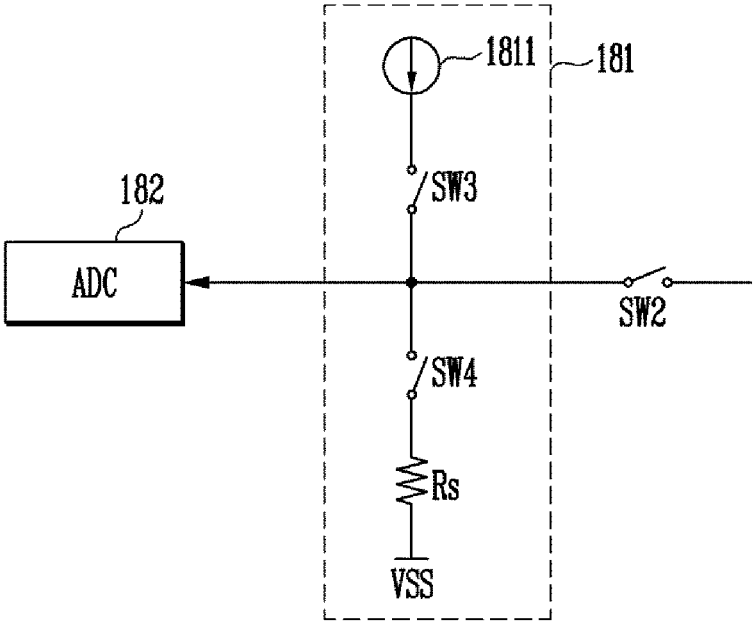

FIG. 3A is a view illustrating the sensing circuit of FIG. 2 according to an embodiment of the present invention.

Referring to FIG. 3A, the sensing circuit 181 includes a current supply unit (e.g., a current supply) 1811, a sensing resistor Rs, a third switch SW3, and a fourth switch SW4.

The current supply unit 1811 supplies the reference current to the data line Dm via the third switch SW3 and the second switch SW2 in a period in which the deterioration information of the organic light emitting diode is extracted. The reference current supplied to the data line Dm is supplied to the organic light emitting diode of the pixel 140 selected by a control signal. At this time, a preset or predetermined voltage is applied to the organic light emitting diode, and the voltage as the deterioration information is supplied to the ADC 182. The reference current is a current supplied to the organic light emitting diode, and a current value thereof may be experimentally determined. For example, the reference current may be set to have the current value corresponding to a white grayscale value.

The third switch SW3 is turned on in the period in which the deterioration information of the organic light emitting diode is extracted.

The fourth switch SW4 and the sensing resistor Rs are connected between the second switch SW2 and a fourth power source VSS (for example, a ground power source).

The fourth switch SW4 is turned on in the sensing period in which the deviation information of the driving transistors is extracted. When the fourth switch SW4 is turned on, the current as the deviation information is supplied from the data line Dm to the sensing resistor Rs so that a preset or predetermined voltage is applied to the sensing resistor Rs. The voltage applied to the sensing resistor Rs as the deviation information is supplied to the ADC 182.

In addition, when the deterioration information of the organic light emitting diode is not compensated for, the current supply unit 1811 and the third switch SW3 may be removed. When the current value is converted into the digital value by the ADC 182, the fourth switch SW4 and the sensing resistor Rs may be removed. The third switch SW3 and the fourth switch SW4 may be turned on or off in response to the control of the timing controller 150.

Figure 3B:
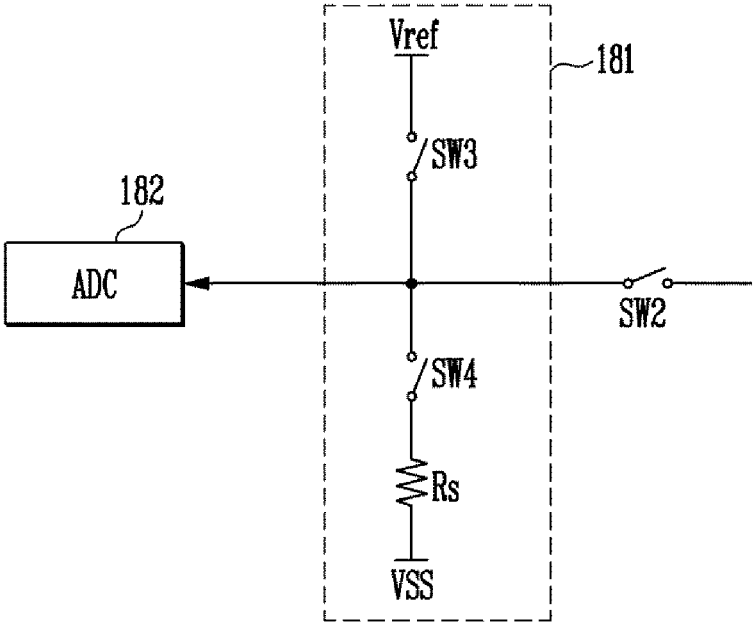

FIG. 3B is a view illustrating the sensing circuit of FIG. 2 according to another embodiment of the present invention. In FIG. 3B, the same elements as those of FIG. 3A are denoted by the same reference numerals and a detailed description thereof may not be provided.

Referring to FIG. 3B, the sensing circuit 181 includes a reference voltage source Vref, the sensing resistor Rs, the third switch SW3, and the fourth switch SW4.

The reference voltage source Vref supplies the reference voltage to the data line Dm via the third switch SW3 and the second switch SW2 in the period in which the deterioration information of the organic light emitting diode is extracted. The reference voltage supplied to the data line Dm is supplied to the organic light emitting diode of the pixel 140 selected by the control signal. At this time, a preset or predetermined current flows through the organic light emitting diode and the current as the deterioration information is supplied to the ADC 182. A voltage value of the reference voltage source Vref is set so that the current may flow through the organic light emitting diode.

The fourth switch SW4 may be turned on in the sensing period. When the fourth switch SW4 is turned on, the current as the deterioration information and/or the deviation information is supplied from the data line Dm to the sensing resistor Rs so that a preset or predetermined voltage is applied to the sensing resistor Rs. The voltage applied to the sensing resistor Rs as the deterioration information and/or the deviation information is supplied to the ADC 182.

In addition, when the deterioration information of the organic light emitting diode is not compensated for, the reference voltage source Vref and the third switch SW3 may be removed.

Figure 4:
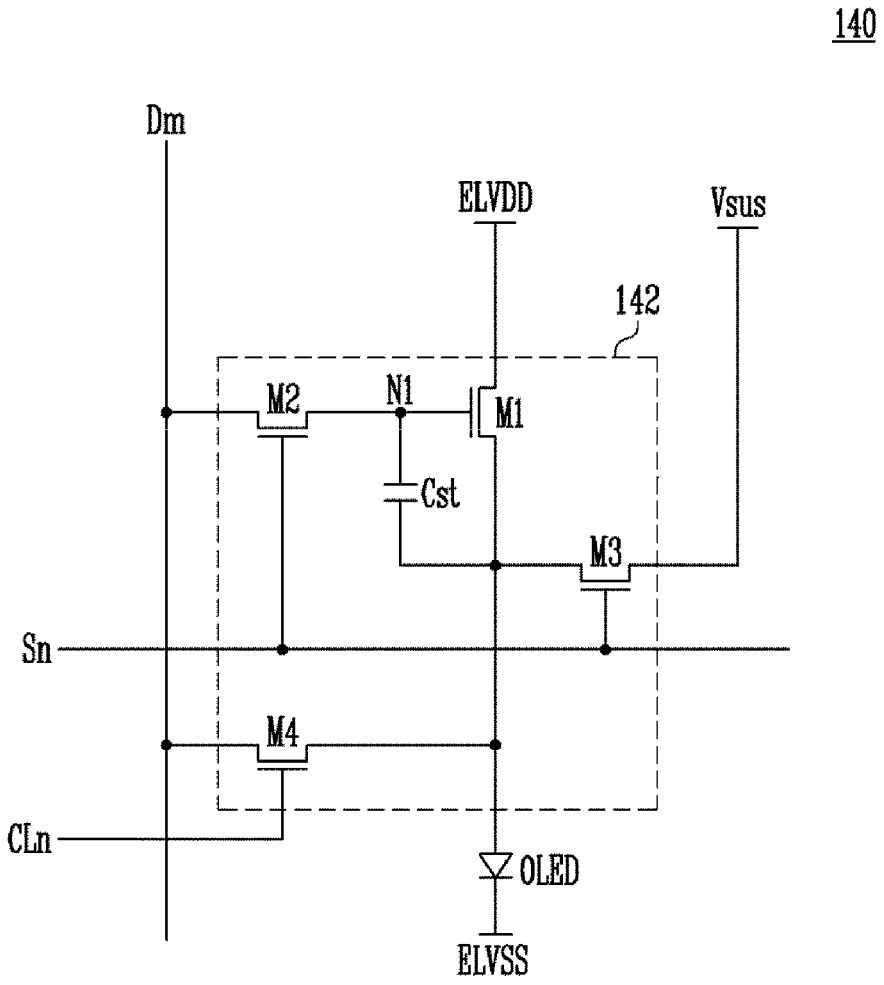

FIG. 4 is a view illustrating a pixel according to an embodiment of the present invention. In FIG. 4, for ease of illustration, the pixel connected to the mth data line Dm and the nth scan line Sn is illustrated.

Referring to FIG. 4, the pixel 140 according to the present invention includes an organic light emitting diode OLED and a pixel circuit 142 for supplying a current to the organic light emitting diode OLED.

An anode electrode of the organic light emitting diode OLED is connected to the pixel circuit 142, and a cathode electrode thereof is connected to the second power source ELVSS. The organic light emitting diode OLED generates light with a preset or predetermined brightness in response to the amount of the current supplied from the pixel circuit 142.

The pixel circuit 142 controls the amount of the current that flows from the first power source ELVDD to the second power source ELVSS via the organic light emitting diode OLED in response to the data signal. For this purpose, the pixel circuit 142 includes a first transistor M1 to a fourth transistor M4 and a storage capacitor Cst. In some examples, the first transistor M1 to the fourth transistor M4 are formed of n-channel metal-oxide-semiconductor field-effect transistors (MOSFET) (NMOS). The second power source ELVSS is set to have a lower voltage than the first power source ELVDD.

A first electrode of the first transistor M1 (i.e., a driving transistor) is connected to the first power source ELVDD, a second electrode thereof is connected to the anode electrode of the organic light emitting diode OLED, and a gate electrode thereof is connected to a first node N1. The first transistor M1 controls the amount of the current that flows from the first power source ELVDD to the second power source ELVSS via the organic light emitting diode OLED in response to a voltage of the first node N1.

A first electrode of the second transistor M2 is connected to the data line Dm, a second electrode thereof is connected to the first node N1, and a gate electrode thereof is connected to the scan line Sn. The second transistor M2 is turned on when the scan signal is supplied to the scan line Sn so that the data line Dm and the first node N1 are electrically connected.

A first electrode of the third transistor M3 is connected to the anode electrode of the organic light emitting diode OLED, a second electrode thereof is connected to a third power source Vsus, and a gate electrode thereof is connected to the scan line Sn. The third transistor M3 is turned on when the scan signal is supplied to the scan line Sn and supplies a voltage of the third power source Vsus to the anode electrode of the organic light emitting diode OLED. Here, the third power source Vsus is set to have a voltage at which the organic light emitting diode OLED may be turned off. For example, the third power source Vsus may be set to have the same or substantially the same voltage as the second power source ELVSS. When the third power source Vsus is set to have the same or substantially the same voltage as the second power source ELVSS, the third power source Vsus is removed and the third transistor M3 may be connected to the second power source ELVSS.

A first electrode of the fourth transistor M4 is connected to the anode electrode of the organic light emitting diode OLED, a second electrode thereof is connected to the data line Dm, and a gate electrode thereof is connected to the control line CLn. The fourth transistor M4 is turned on when the control signal is supplied to the control line CLn and electrically connects the data line Dm and the anode electrode of the organic light emitting diode OLED.

The storage capacitor Cst is connected between the first node N1 and the anode electrode of the organic light emitting diode OLED. The storage capacitor Cst stores the voltage corresponding to the data signal.

Figure 5A:
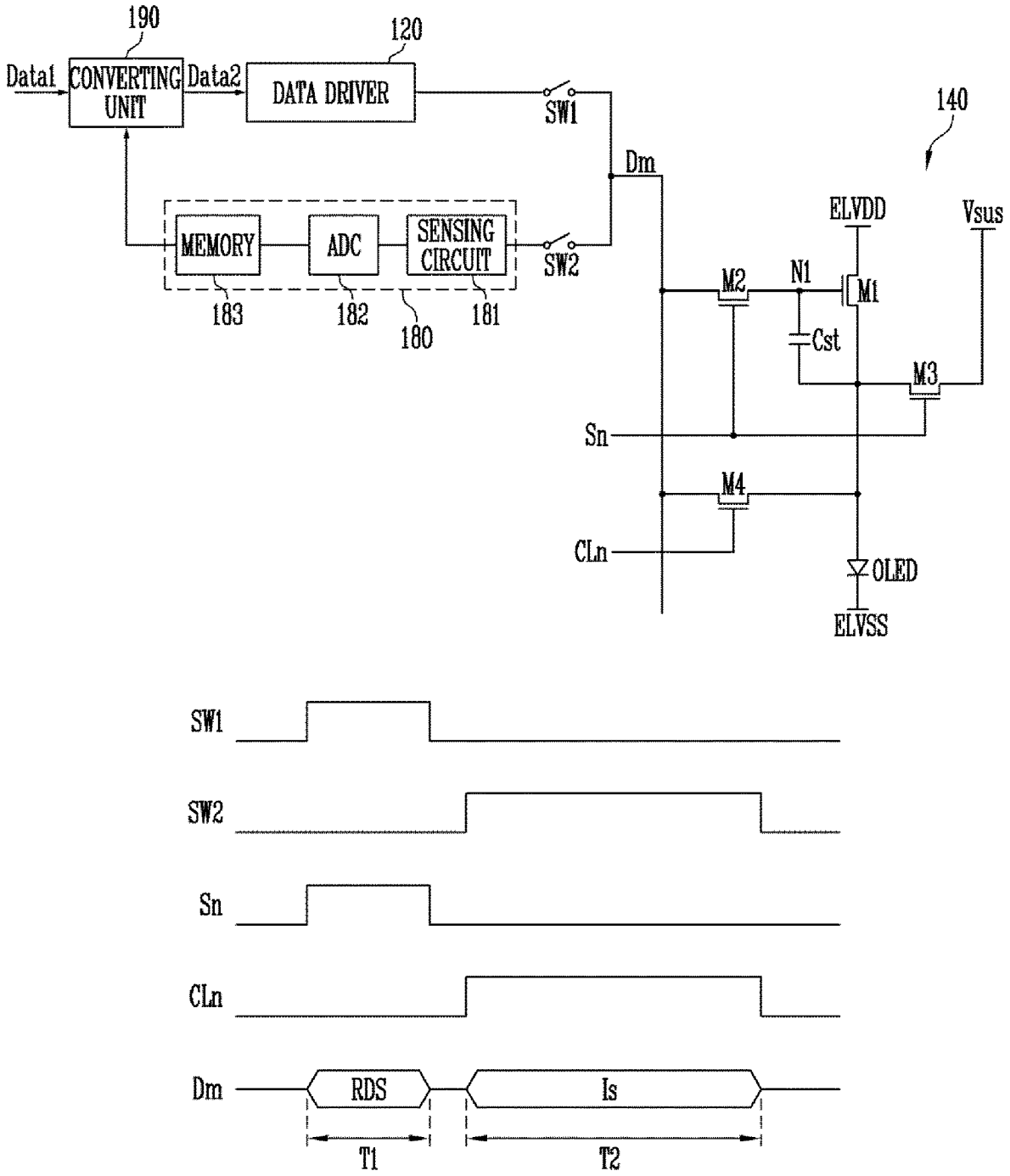

FIG. 5A is a view illustrating waveforms from which deviation information of driving transistors is extracted in a sensing period, according to an embodiment of the present invention. In FIG. 5A, operation processes will be further described by using the pixel connected to the mth data line Dm and the nth scan line Sn.

Referring to FIG. 5A, first, in the first period T1, the first switch SW1 is turned on and the scan signal is supplied to the scan line Sn.

When the scan signal is supplied to the scan line Sn, the second transistor M2 and the third transistor M3 are turned on. When the second transistor M2 is turned on, the data line Dm and the first node N1 are electrically connected. When the third transistor M3 is turned on, the voltage of the third power source Vsus is supplied to the anode electrode of the organic light emitting diode OLED.

When the first switch SW1 is turned on, the data driver 120 and the data line Dm are electrically connected. Then, the reference data signal RDS from the data driver 120 is supplied to the first node N1 of the pixel 140 via the data line Dm.

When the reference data signal RDS is supplied to the first node N1, the storage capacitor Cst charges a subtraction voltage between the reference data signal RDS and the third power source Vsus. Here, the first transistor M1 that receives the reference data signal RDS is set in an on state. The current supplied from the first transistor M1 in the first period T1 is supplied to the third power source Vsus via the third transistor M3 so that the organic light emitting diode OLED maintains a non-emission state.

In the second period T2, the second switch SW2 is turned on and the control signal is supplied to the control line CLn.

When the control signal is supplied to the control line CLn, the fourth transistor M4 is turned on. When the fourth transistor M4 is turned on, the anode electrode of the organic light emitting diode OLED and the data line Dm are electrically connected.

When the second switch SW2 is turned on, the sensing unit 180 and the data line Dm are electrically connected. Then, the current Is is supplied from the first transistor M1 to the sensing unit 180 via the fourth transistor M4. At this time, the current supplied from the first transistor M1 is used as the deviation information of the first transistor M1.

The current Is that flows from the first transistor M1 in the second period T2 is determined in response to the reference data signal RDS. At this time, the current Is that flows from the first transistor M1 may be differently determined in response to the reference data signal RDS in accordance with the threshold voltages and mobility of the first transistors M1 included in the pixels 140. That is, the threshold voltage and mobility of the first transistor M1 are included in the current Is that flows from the first transistor M1 in the second period T2.

In the second period T2, the sensing circuit 181 changes the current Is supplied from the first transistor M1 into a voltage and supplies the voltage to the ADC 182. The ADC 182 changes the current Is or the voltage supplied from the sensing circuit 181 into a digital value as the deviation information and supplies the changed digital value to the memory 183. The memory 183 stores the digital value supplied from the ADC 182 as the deviation information of the corresponding pixel.

According to the present invention, the above-described processes are repeated and the deviation information of the pixels 140 is stored in the memory 183.

In addition, the sensing period in which the deviation information is extracted may be included at least once before the organic light emitting display device is forward biased (e.g., forwarded or turned ON). In addition, the sensing period may be included every set period of time (e.g., predetermined time) after the organic light emitting display device is forward biased (e.g., forwarded).

Figure 5B:
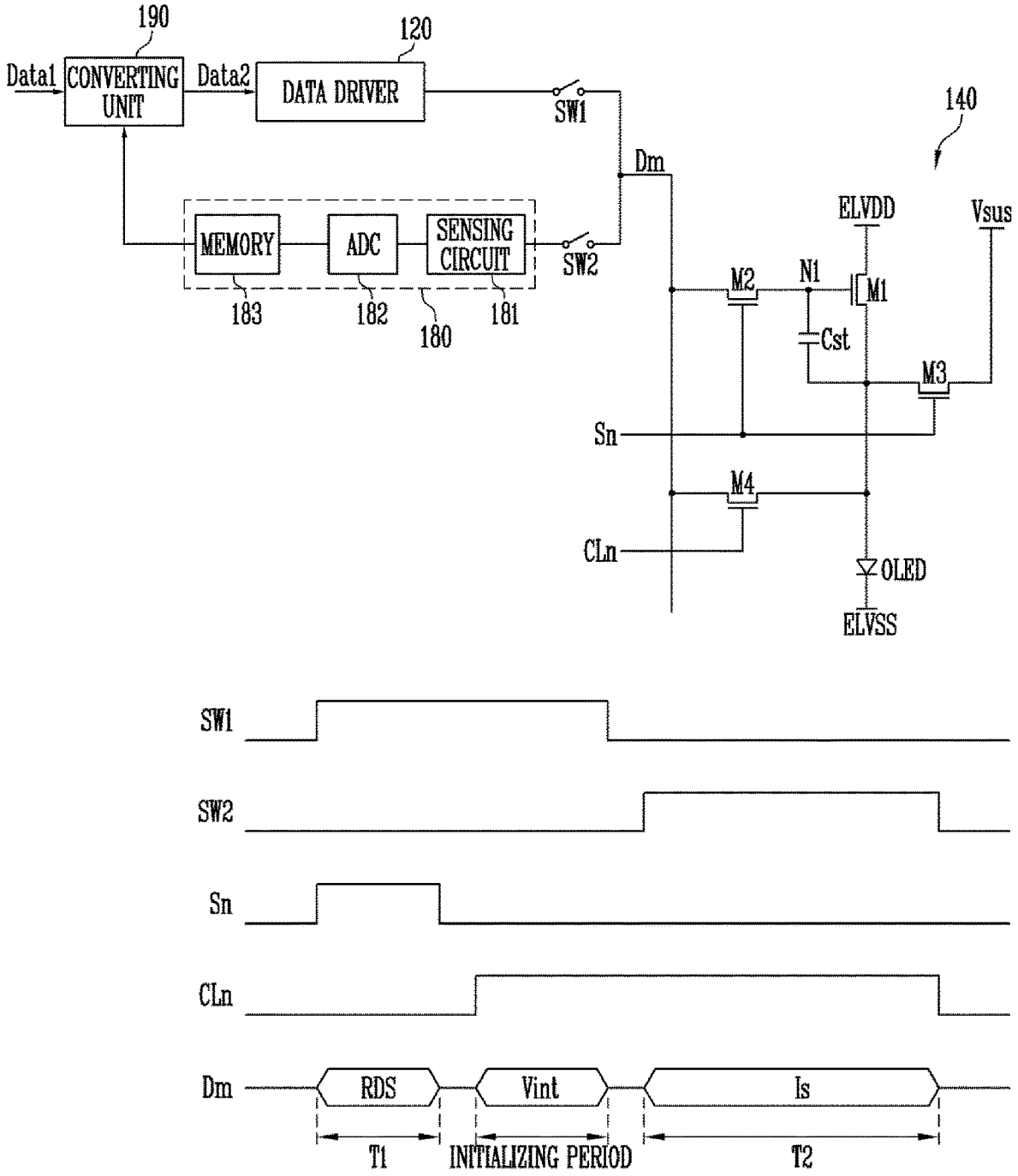

FIG. 5B is a view illustrating waveforms from which deviation information of driving transistors is extracted in a sensing period, according to another embodiment of the present invention. In FIG. 5B, a detailed description of the same elements as those of FIG. 5A may not be provided.

Referring to FIG. 5B, according to another embodiment of the present invention, an initializing period is added between the first period T1 and the second period T2.

In the initializing period, the first switching SW1 is turned on and the control signal is supplied to the control line CLn.

When the control signal is supplied to the control line CLn, the fourth transistor M4 is turned on. When the fourth transistor M4 is turned on, the anode electrode of the organic light emitting diode OLED and the data line Dm are electrically connected.

When the first switch SW1 is turned on, the data driver 120 and the data line Dm are electrically connected. Then, the initializing voltage Vint from the data driver 120 is supplied to the anode electrode of the organic light emitting diode OLED via the data line Dm. At this time, the data line Dm and the anode electrode of the organic light emitting diode OLED are initialized by the initializing voltage Vint.

That is, in the initializing period for initializing the data line Dm, deviation among channels is removed. That is, in the initializing period, the data line Dm and the anode electrode of the organic light emitting diode OLED are initialized to the initializing voltage Vint so that the current supplied from the first transistor M1 in the second period T2 may be supplied to the sensing unit 180 regardless of (and in spite of) the deviation among the channels. In addition, in order to prevent or substantially prevent light from being undesirably emitted, the initializing voltage Vint may be set as the voltage at which the organic light emitting diode OLED is turned off.

Figure 6A:
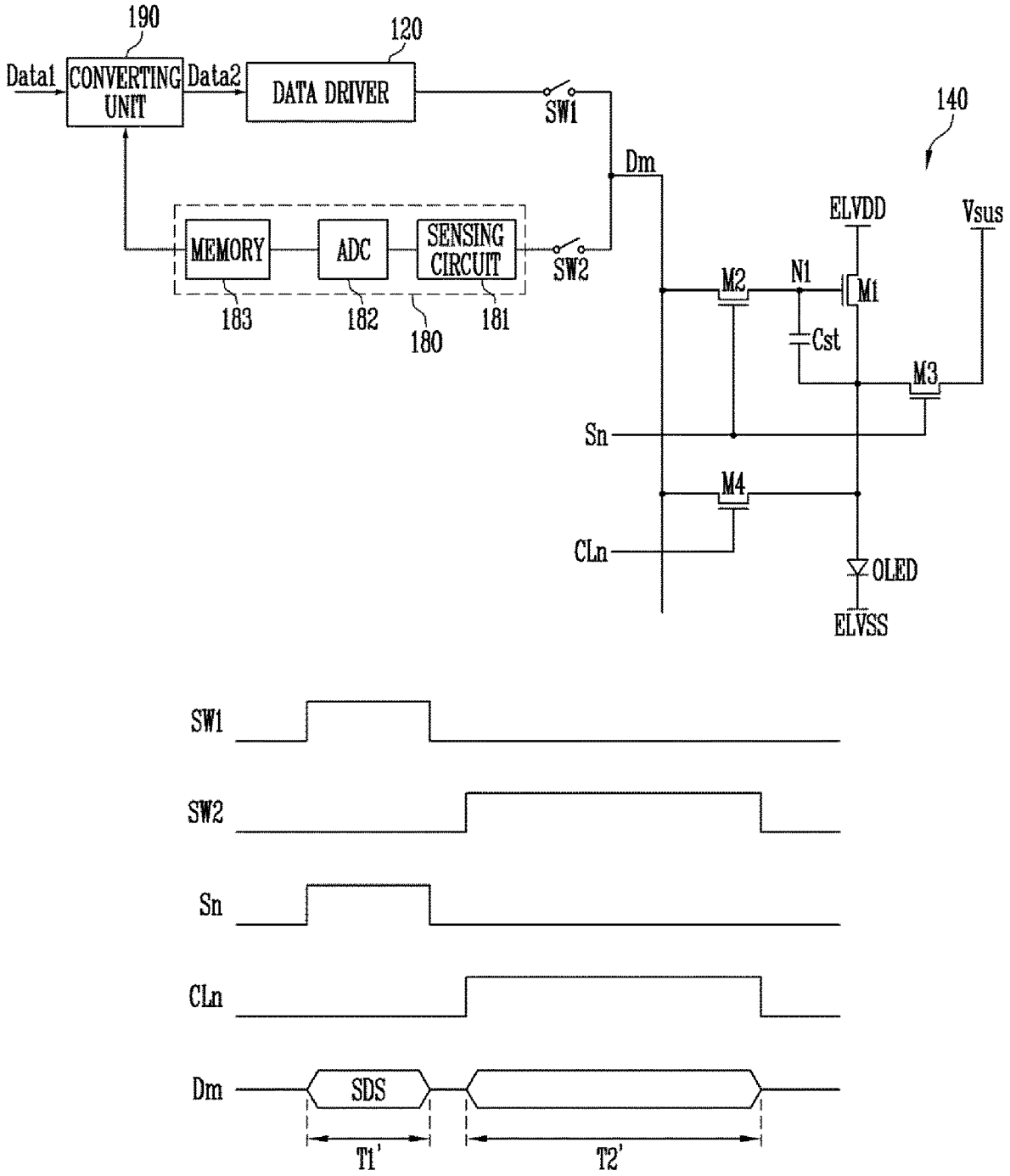

FIG. 6A is a view illustrating waveforms from which deterioration information of an organic light emitting diode (OLED) is extracted in a sensing period, according to an embodiment of the present invention. In FIG. 6A, operation processes will be described by using the pixel connected to the mth data line Dm and the nth scan line Sn.

Referring to FIG. 6A, first, in a first period T1', the first switch SW1 is turned on and the scan signal is supplied to the scan line Sn.

When the scan signal is supplied to the scan line Sn, the second transistor M2 and the third transistor M3 are turned on. When the second transistor M2 is turned on, the data line Dm and the first node N1 are electrically connected. When the third transistor M3 is turned on, the voltage of the third power source Vsus is supplied to the anode electrode of the organic light emitting diode OLED.

When the first switch SW1 is turned on, the data driver 120 and the data line Dm are electrically connected. Then, the sensing data signal SDS from the data driver 120 is supplied to the first node N1 of the pixel 140 via the data line Dm.

When the sensing data signal SDS is supplied to the first node N1, the storage capacitor Cst charges a subtraction voltage between the sensing data signal SDS and the third power source Vsus. Here, the sensing data signal SDS is set as the data signal corresponding to the black grayscale value having the voltage at which the first transistor M1 is turned off. Therefore, when the sensing data signal SDS is supplied to the first node N1, the first transistor M1 is set in an off state.

In a second period T2', the second switch SW2 is turned on, and the control signal is supplied to the control line CLn.

When the control signal is supplied to the control line CLn, the fourth transistor M4 is turned on. When the fourth transistor M4 is turned on, the anode electrode of the organic light emitting diode OLED and the data line Dm are electrically connected.

When the second switch SW2 is turned on, the sensing unit 180 and the data line Dm are electrically connected. At this time, the sensing circuit 181 supplies the reference voltage from the reference voltage source Vref or the reference current from the current supplying unit 1811 to the data line Dm. The reference voltage or the reference current supplied to the data line Dm is supplied to the anode electrode of the organic light emitting diode OLED.

When the reference voltage is supplied to the data line Dm, a preset or predetermined current corresponding to the reference voltage flows to the organic light emitting diode OLED, and the current as the deterioration information is supplied to the sensing circuit 181. When the reference current is supplied to the data line Dm, a preset or predetermined voltage corresponding to the reference current is applied to the organic light emitting diode OLED, and the voltage as the deterioration information is supplied to the sensing circuit 181.

In the second period T2', the sensing circuit 181 receives the preset or predetermined voltage or the preset or predetermined current as the deterioration information and supplies the received voltage or current to the ADC 182. Here, the sensing circuit 181 changes the current supplied thereto into a voltage and supplies the voltage to the ADC 182. The ADC 182 changes the current or the voltage supplied from the sensing circuit 181 as the deterioration information into a digital value and supplies the changed digital value to the memory 183. The memory 183 stores the digital value supplied from the ADC 182 as the deterioration information of the corresponding pixel.

According to the present invention, the above-described processes are repeated, and the deterioration information of each of the pixels 140 is stored in the memory 183.

In addition, the sensing period in which the deterioration information is extracted may be included at least once before the organic light emitting display device is forward biased (e.g., forwarded). In addition, the sensing period may be included every set period of time (e.g., predetermined time) after the organic light emitting display device is forward biased (e.g., forwarded).

Figure 6B:
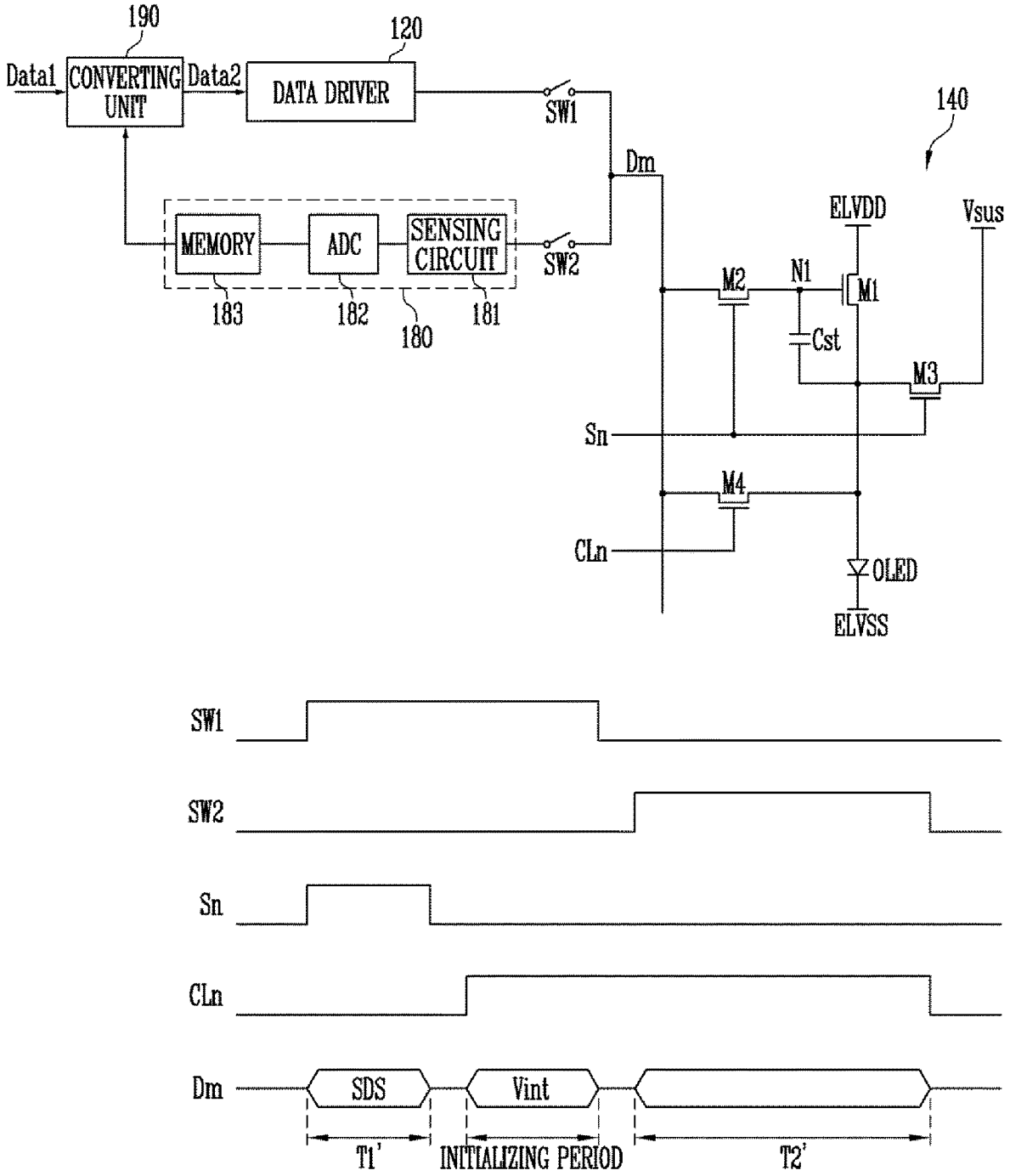

FIG. 6B is a view illustrating waveforms from which deterioration information of an OLED is extracted in a sensing period, according to another embodiment of the present invention. In FIG. 6B, a detailed description of the same elements as those of FIG. 6A may not be provided.

Referring to FIG. 6B, according to another embodiment of the present invention, an initializing period is added between the first period T1' and the second period T2'.

In the initializing period, the first switching SW1 is turned on, and the control signal is supplied to the control line CLn.

When the control signal is supplied to the control line CLn, the fourth transistor M4 is turned on. When the fourth transistor M4 is turned on, the anode electrode of the organic light emitting diode OLED and the data line Dm are electrically connected.

When the first switch SW1 is turned on, the data driver 120 and the data line Dm are electrically connected. Then, the initializing voltage Vint from the data driver 120 is supplied to the anode electrode of the organic light emitting diode OLED via the data line Dm. In the initializing period for initializing the data line Dm to the initializing voltage Vint, deviation among channels is removed.

Figure 7:
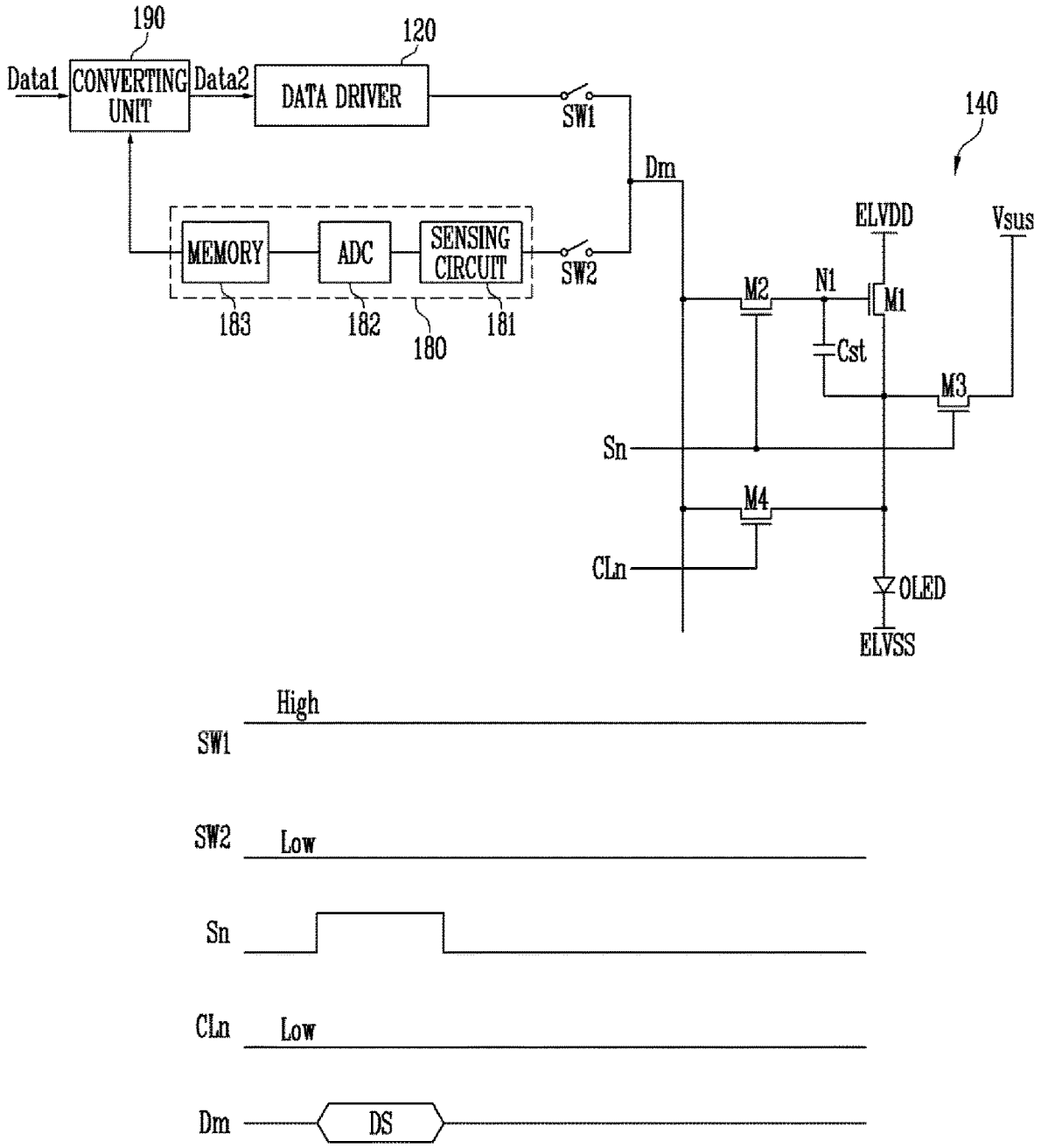

FIG. 7 is a view illustrating waveforms supplied to a pixel in a driving period according to an embodiment of the present invention. In FIG. 7, operation processes will be described by using the pixel connected to the mth data line Dm and the nth scan line Sn.

Referring to FIG. 7, in the driving period, the first switch SW1 maintains an on state and the second switch SW2 maintains an off state.

In the driving period, the converting unit 190 changes the bit of the first data Data1 in response to the digital value(s) (i.e., the deviation information and/or the deterioration information) stored in the memory 183 and generates the second data Data2.

In the driving period, the data driver 120 generates the data signal DS by using the second data Data2. Then, the pixels 140 that receive the data signal DS may implement grayscale values with desired brightness components regardless of (and in spite of) the deviation among the first transistors M1 and/or the deterioration of the organic light emitting diodes OLED.

In the driving period, when the scan signal is supplied to the scan line Sn, the second transistor M2 and the third transistor M3 are turned on. When the third transistor M3 is turned on, the voltage of the third power source Vsus is supplied to the anode electrode of the organic light emitting diode OLED. When the second transistor M2 is turned on, the data signal DS from the data line Dm is supplied to the first node N1. At this time, the storage capacitor Cst stores a voltage corresponding to the data signal DS. Also, in the period in which the scan signal is supplied to the scan line Sn, the current supplied from the first transistor M1 in response to the data signal DS is supplied to the third power source Vsus so that the organic light emitting diode OLED maintains an off state.

When supply of the scan signal to the scan line Sn is stopped, the second transistor M2 and the third transistor M3 are turned off. Then, the current from the first transistor M1 is supplied to the organic light emitting diode OLED in response to the data signal DS so that the organic light emitting diode OLED emits light in response to the data signal DS.

In addition, when the organic light emitting diode OLED emits light, the voltage of the anode electrode of the organic light emitting diode OLED is changed from the voltage of the third power source Vsus into a preset or predetermined voltage. For example, the voltage of the anode electrode of the organic light emitting diode OLED may be changed in response to the voltage value of the first power source ELVDD.

At this time, because the first node N1 is set to be electrically floating, the voltage charged in the storage capacitor Cst maintains a voltage in a previous period (i.e., the voltage Vgs is maintained). Therefore, according to the present invention, influence that the voltage drop of the first power source ELVDD has on the current of the first transistor M1 is reduced or minimized so that a desired grayscale value may be implemented.

According to the present invention, the above-described processes are repeated, and a grayscale value corresponding to the data signal DS is implemented by (represented by) the pixels 140. In addition, according to the present invention, grayscale values may be implemented regardless of (and in spite of) the deterioration of the organic light emitting diodes OLED and/or the deviation among the first transistors M1 and the voltage drop of the first power source ELVDD, so that display quality may be improved.

According to the present invention, the organic light emitting diodes OLED may generate various light components (colors) including red, green, and blue light components in response to the amounts of the currents supplied from the driving transistors. However, the present invention is not limited thereto. For example, the organic light emitting diodes OLED may generate white light in response to the amounts of the currents supplied from the driving transistors. In this case, a color image may be implemented by using an additional color filter (or additional color filters).

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept."

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the example embodiments of the present invention.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. An organic light emitting display device comprising:

pixels at crossing regions of scan lines, control lines, and data lines;

a data driver configured to supply data signals to the data lines;

a compensator configured to extract compensation information of the pixels in a sensing period and configured to generate second data by changing a bit of first data input from the outside using the compensation information, wherein each of the pixels comprises:

an organic light emitting diode;

a first transistor configured to control an amount of a current that flows from a first power source to a second power source via the organic light emitting diode in response to a voltage of a first node;

a second transistor connected between the data driver and the first node and configured to turn on when a scan signal is supplied to a scan line;

a third transistor connected between the compensator and an anode electrode of the organic light emitting diode and configured to turn on when a control signal is supplied to a control line, the control signal being offset in time from the scan signal during the sensing period; and a storage capacitor having one end having an electrically same node with the first node and another end having an electrically same node with the anode electrode of the organic light emitting diode, and wherein the compensation information comprises at least one of deviation information of the first transistor and deterioration information of the organic light emitting diode.

2. The organic light emitting display device of claim 1, wherein the first, the second, and the third transistors comprise n-channel metal-oxide-semiconductor field-effect transistors (NMOSs).

3. The organic light emitting display device of claim 1, wherein the compensator is configured to generate the second data to compensate for at least one of deviation of the first transistor and deterioration of the organic light emitting diode.

4. The organic light emitting display device of claim 1, wherein the compensator comprises:

an analog-to-digital converter (ADC) configured to change the compensation information into a digital value; and a memory configured to store the digital value.

5. The organic light emitting display device of claim 1, further comprising:

a scan driver configured to supply scan signals comprising the scan signal to the scan lines; and a control line driver configured to supply control signals comprising the control signal to the control lines, wherein the data driver is configured to generate the data signals by using the second data and to supply the data signals to the data lines.

6. The organic light emitting display device of claim 5, wherein, in a sensing period in which the deviation information of the pixels is extracted, the scan driver is configured to supply the scan signal to the scan line in a first period, and the control line driver is configured to supply the control signal to the control line in a second period.

7. The organic light emitting display device of claim 6, wherein the data driver is further configured to supply a reference data signal to turn on the first transistor in the first period.

8. The organic light emitting display device of claim 6, wherein the deviation information comprises a current supplied from the first transistor to the compensator in the second period.

9. The organic light emitting display device of claim 6, wherein, in an initializing period between the first period and the second period, the data driver is configured to supply an initializing voltage to the data lines.

10. The organic light emitting display device of claim 9, wherein the initializing voltage is a voltage at which the organic light emitting diode is turned off.

11. The organic light emitting display device of claim 6, wherein the first transistor is configured to electrically connect to the first power source in the second period.

12. The organic light emitting display device of claim 5, wherein, in a sensing period in which the deterioration information of the pixels is extracted, the scan driver is configured to supply the scan signal to the scan line in a first period, and the control line driver is configured to supply the control signal to the control line in a second period.

13. The organic light emitting display device of claim 12, wherein the data driver is further configured to supply a sensing data signal corresponding to a black grayscale value to the first node in the first period.

14. The organic light emitting display device of claim 12, wherein the compensator is configured to supply a reference current or a reference voltage to the organic light emitting diode in the second period.

15. The organic light emitting display device of claim 14, wherein the deterioration information comprises a voltage applied to the organic light emitting diode in response to the reference current or a current that flows from the organic light emitting diode in response to the reference voltage.

16. The organic light emitting display device of claim 12, wherein, in an initializing period between the first period and the second period, the data driver is configured to supply an initializing voltage to the data lines.

17. The organic light emitting display device of claim 16, wherein the initializing voltage is a voltage at which the organic light emitting diode is turned off.

18. The organic light emitting display device of claim 12, wherein the first transistor is configured to electrically connect to the first power source in the second period.

* * * * *